United States Patent [19]

Gulya

[11] 3,999,493

[45] Dec. 28, 1976

[54] VAULTS AND SAFES EMPLOYING ELECTRICAL PANEL ASSEMBLIES

[76] Inventor: Joseph Gulya, 16 Concord St., Edison, N.J. 08817

[22] Filed: Apr. 7, 1975

[21] Appl. No.: 565,624

[52] U.S. Cl. ..... 109/23 R; 109/54; 312/204

[51] Int. Cl.[2] ..... E05G 1/02

[58] Field of Search ..... 109/23, 50, 54, 59, 109/64; 312/204

[56] References Cited

UNITED STATES PATENTS

| | | | |
|---|---|---|---|
| 968,536 | 8/1910 | Brucklacher | 109/50 |
| 1,546,884 | 7/1925 | Burnett | 109/50 |
| 2,819,692 | 1/1958 | Johnson et al. | 109/50 |
| 3,386,393 | 6/1968 | Peterson et al. | 109/50 |
| 3,717,112 | 2/1973 | Welty | 109/23 |

FOREIGN PATENTS OR APPLICATIONS

| | | | |
|---|---|---|---|
| 373,553 | 4/1923 | Germany | 109/50 |

*Primary Examiner*—Paul R. Gilliam
*Assistant Examiner*—David H. Corbin
*Attorney, Agent, or Firm*—Arthur L. Plevy

[57] ABSTRACT

There is disclosed a vault for the retention of valuables, which is positioned on a wall of a home or industrial complex and has the appearance of a conventional electrical outlet, such as a fuse panel, a plug assembly and so on. The vault is rotatably mounted in the wall and includes a catch or lock mechanism which operates by accessing one of the electrical components to enable a user to selectively open or close the vault.

6 Claims, 8 Drawing Figures

ON
OFF

VAULTS AND SAFES EMPLOYING ELECTRICAL PANEL ASSEMBLIES

BACKGROUND OF THE INVENTION

This invention relates to safes or vaults, and, more particularly to a safe or vault which assumes the appearance of an electrical outlet or component, typically found in the every day environment.

There are virtually a plethora of devices generally designated as safes or vaults, which are utilized in the home or office establishments to retain valuables.

Certain devices used in the home or elsewhere are referred to as wall safes and are usually covered or located behind a picture or panel, to hide the device from a burglar.

The prior art was also cognizant of such problems and reference can be made to U.S. Pat. No. 331,163 entitled HOUSEHOLD FURNITURE by F. Shannon issued on Nov. 24, 1885. This patent depicts a safe or vault concealed within a bureau. U.S. Pat. No. 1,546,884 entitled VAULT by H. S. Burnett issued on July 21, 1925 shows a safe located within the mantel of a fireplace and assuming the appearance of a conventional mantel decoration.

Essentially, the object of these patents is to provide a user with a repository for valuables which assumes the appearance of an ordinary household instrumentality. The philosophy is to "hide" or obscure the safe so that an intruder will not easily locate the same and, in fact, may never find the unit.

While such devices exist, they are generally cumbersome and difficult to fabricate and install, and do not lend themselves to adaptation with modern day dwellings.

It is therefore an object of this invention to provide an improved vault which assumes the appearance of a conventional electrical outlet to obscure the same while further discouraging an intruder from gaining access to the unit.

BRIEF DESCRIPTION OF PREFERRED EMBODIMENT

A secret safe or concealed repository for mounting on a wall, comprising of a front panel having located thereon at least one electrical component, a hollow repository coupled to said panel and having an opening for inserting valuables therein and means for mounting said safe on said wall with said front panel exposed to view with said repository located behind said wall.

DETAILED DESCRIPTION OF FIGURES

Figures 1, 2, 3, 4, 5, 6, 7, 8:
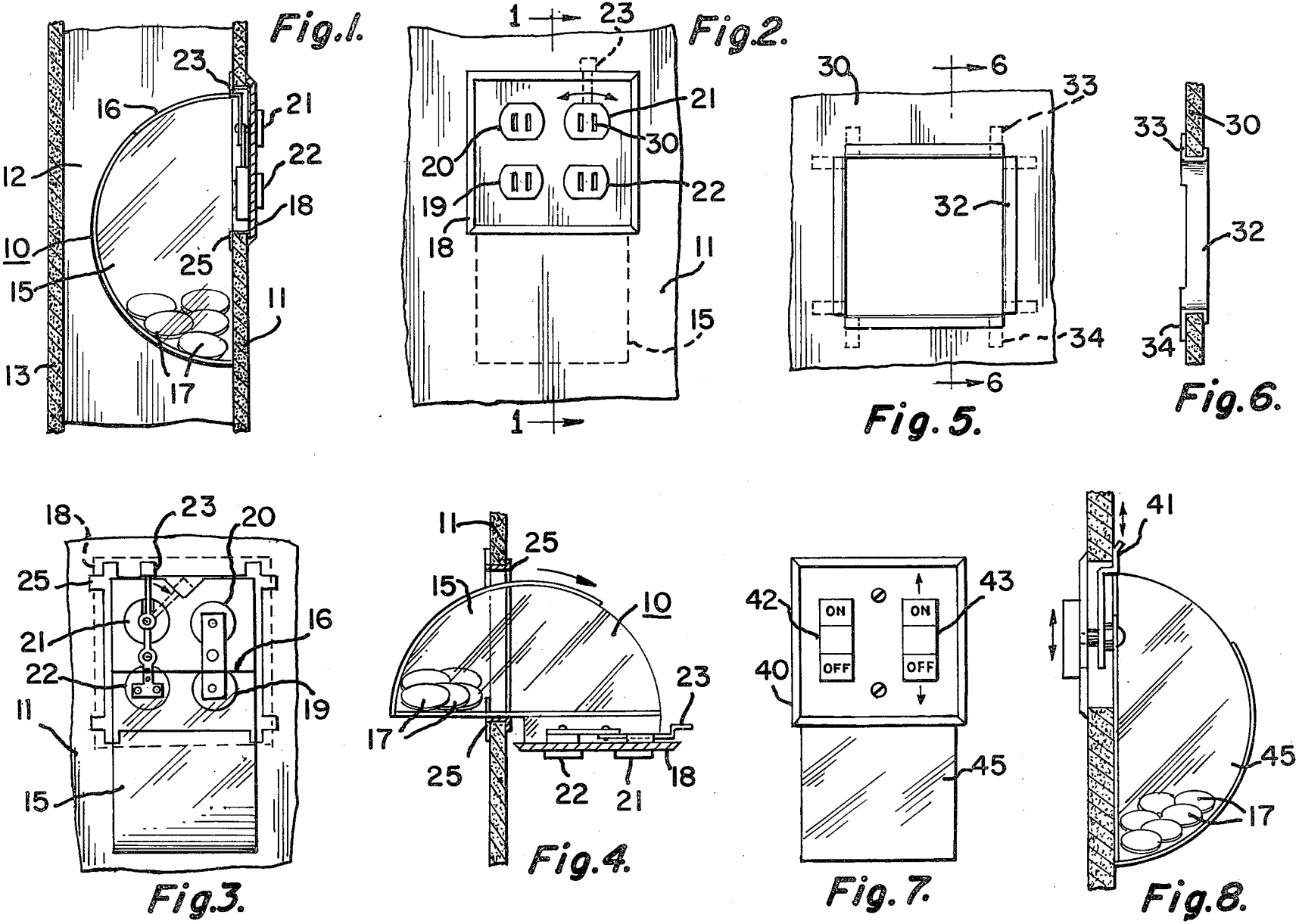
FIG. 1 is a side elevational view of a safe installed in a wall according to this invention.
FIG. 2 is a front perspective view of the unit of FIG. 1.
FIG. 3 is a rear view of a safe according to FIG. 1.
FIG. 4 is a sectional view showing an opened safe position.
FIG. 5 is a front view of a mounting sleeve, according to this invention.
FIG. 6 is a side view of the sleeve of FIG. 5.
FIG. 7 is a front perspective view of an alternate embodiment of a safe according to the invention.
FIG. 8 is a side view of the unit of FIG. 7.

Before proceeding with a detailed description, a few opening remarks will serve to clarify the objects and design considerations of the vault according to the invention.

The units to be described assume the appearance of conventional electrical units as commonly found in a modern home, building and so on. They appear, for example, as conventional wall plugs, switch plates, circuit breaker panels and so on. The primary consideration is to first hide or obscure the units from an intruder as evidenced by certain prior art approaches, as above indicated. More important is the fact that such devices as assuming the appearance of electrical components will impart a certain sense of caution to an intruder, due to the nature of electricity and hence, one would not normally tamper with such units, as the possibility of electrical shock exists.

Thus, the apparatus to be described affords a double advantage to a user, namely the ability to both obscure the safe and to assume that due to the nature of electrical units, that it will not be tampered with because of the electrical shock aspect.

The components may be formed directly on the panel of the unit, as they are non-functional, but look exactly like electrical components or may, in fact, be actual electrical components and plates as offered and sold in a hardware or home supply store.

Referring to FIG. 1, there is shown a side elevational view of a safe 10 mounted in a wall 11.

Conventionally, most modern establishments have walls fabricated from sheet rock and thence a sheet rock panel 11 is secured to a stud as 12. Another panel as 13 may be secured to the other side of the stud. The studs as 12 as centered about every sixteen inches or so and the sheet rock panels are secured at intervals to form a wall as 11. Hence, there are spaces between the panels 11 and 13 where the studs as 12 are not located.

The vault 10 is dimensioned to fit within the recess between the walls as shown.

The vault includes a valuable possession repository section 15, which has a semi-circular side configuration, as shown. The section 15 has an opening 16 near the top to enable one to place valuables 17, as coins, jewelry, money and so on therein.

The repository section 15 is coupled to a front plate or panel section 18. Section 18 (FIG. 2) appears as an ordinary electrical plug assembly and may have for example, four female outlets as 19, 20, 21 and 22 on the surface thereof.

It is noted that although a female plug panel 18 is shown, any other electrical component could be used as well, as a circuit breaker, switch; it being understood that the desireable appearance is one of an electrical assembly so that the shock hazard is prevalent.

As will be described, the mounting and positioning of the safe 10 in a wall is extremely simple. One merely cuts a rectangular hole in the wall at any desired location and according to the dimensions of a typical plate as 18. A sleeve 25 (FIG. 1) is inserted into the hole. The sleeve 25 may be fabricated from sheet metal or plastic. The safe unit 10 is then inserted through the sleeve and is secured by the panel 18, which is larger than the sleeve 25 and the hole in the wall. One of the plugs as 21 or more than one, is rotatable or moveable and is coupled to a latch mechanism as 23 (FIG. 2 and FIG. 1). Thus, for the position shown or the normal position of plug 21, the latch 23 abuts against the sleeve 25 or the wall and locks the safe 10 in place. The rotation of the plug 21 (arrow of FIG. 2), moves the latch 23 so one can now remove the entire safe assembly from the wall.

FIG. 3 shows a rear view of the unit. The latch 23 is coupled to the plug 21 by a screw or fastener and is rotatably secured thereto. Hence, a rotation of the plug 21 rotates the latch, which can then move out of coaction with the sleeve 25 or unlock. While simple latches are shown, it is understood that more complicated devices can be employed to afford locking. Since the plug 21 is relatively flush with the panel 18, one might insert a key or a metal object into an aperture as 30 of the outlet to aid in rotation. The user will have no fear of doing so, as he knows there is no power associated therewith, however, an intruder would not do so.

FIG. 4 shows a side view of the safe 10 after the latch is released. One can simply remove the entire depository from the wall or rotate the same as shown in FIG. 4. Hence, the valuables 17 can be easily inserted or removed.

FIG. 5 shows a front view of a section of a wall as 30 with a sleeve 32 inserted therein.

The sleeve 32 as indicated, is fabricated from sheet metal or plastic and is inserted into the aperture formed in the wall. Since the safe 10 is dimensioned as shown, it is then inserted directly into the hole with the plate 18 being larger than the sleeve 32 to cover the same and prevent the safe 10 from falling into the wall.

FIG. 6 shows a side view of the sleeve 32. The sleeve may have tabs as 33 and 34, which are bent upwards as shown in FIG. 5, to secure the sleeve to the wall and hold the same firmly in place.

FIGS. 7 and 8 show an alternate configuration for such a safe.

In FIG. 7, a panel 40 assumes the appearance of a light or wall switch. One or both switches 42 and 43 may be coupled to a latch as 41. If the switch is moved to the "off" position, the latch moves into coaction with the sleeve or wall 45, in the "on" position, the latch is moved out of coaction and the safe 45 can be easily removed from the wall as shown above.

While a few simple embodiments have been shown, it will become apparent to those skilled in the art that many alternate embodiments could be implemented. Hence, the vault configurations need not be semi-circular in shape, but other shapes would suffice. The repository 15 could be fabricated from a fire-proof material as could the entire unit; or a plastic and so on. Other electrical components could house and obscure larger units, such as one could utilize circuit breaker or fuse panels to obscure large repositorys and so on.

Hence, the appended claims are included to define the scope of the protection intended as all such equivalents shall be deemed to be encompassed within the spirit and scope of the invention.

What is claimed:

1. A secret safe or repository adapted for mounting in a hole on a wall and located between the space formed by two walls of a dwelling with a front panel positioned for view on one of the walls, comprising:

a. a sleeve relatively congruent with said hole and rigidly positioned in said hole, b. a front panel of a larger dimension than said sleeve having located on a first surface positioned for view, an electrical component, of the type indicative of creating an appearance to present an electrical shock hazard to a viewer, said electrical component comprising at least one conventional female power socket assembly of the type having apertures adapted to accommodate a conventional male power connector, c. a repository section firmly coupled to said front panel on a surface opposite to that containing said component, said repository having a object accommodating hollow for retaining valuables, d. a latch coupled to said electrical component and moveable with respect to said front panel to coact with said sleeve when said safe is emplaced therein with said repository located between said walls and said front panel exposed for view on one of said walls, said latch functioning to retain said panel relatively flush with said wall in a first position and operative in a second position to permit the removal of said repository and said panel from said hole, said latch positioned to be operated by means inserted into said apertures of said socket assembly, and latch operating means for insertion into said socket to operate said latch between said first and second positions.

2. The safe according to claim 1 wherein said front panel is generally rectangular in shape as in said hole and is larger than said hole and said sleeve to cover the same when said safe is emplaced on said wall.

3. The secret safe according to claim 1 wherein said latch operating means inserted into said socket comprises a key.

4. The secret safe according to claim 1 wherein said repository is of a width less than the space between said wall and of a length greater than said space whereby said repository extends downwardly from said front panel when emplaced between said walls.

5. The secret safe according to claim 1 including a second female power socket located beneath said at least one to form a conventional appearing female wall socket assembly.

6. The secret safe according to claim 1 wherein said sleeve includes extending tabs which are bent after placement of the sleeve to coact with the peripheral edges of said wall about said hole.

* * * * *